US007530673B2

(12) United States Patent
Sumi

(10) Patent No.: US 7,530,673 B2
(45) Date of Patent: May 12, 2009

(54) ACTUATOR DEVICE, LIQUID-JET HEAD AND LIQUID-JET APPARATUS

(75) Inventor: Koji Sumi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 457 days.

(21) Appl. No.: 11/501,040

(22) Filed: Aug. 9, 2006

(65) Prior Publication Data

US 2007/0035590 A1 Feb. 15, 2007

(30) Foreign Application Priority Data

Aug. 11, 2005 (JP) ..... 2005-233367

(51) Int. Cl.
*B41J 2/045* (2006.01)

(52) U.S. Cl. ..... 347/68

(58) Field of Classification Search ..... 347/68, 347/69–72; 400/124.16; 310/317, 323.17, 310/311

See application file for complete search history.

(56) References Cited

U.S. PATENT DOCUMENTS 5,165,809 A * 11/1992 Takahashi et al. ..... 400/124.16
5,657,063 A 8/1997 Takahashi
7,083,270 B2 8/2006 Torii et al.
7,185,540 B2 3/2007 Torii et al.

FOREIGN PATENT DOCUMENTS

| | | |
|---|---|---|
| CN | 1471181 A | 1/2004 |
| JP | 5-286131 A | 11/1993 |
| JP | 2001-509312 A | 7/2001 |
| WO | WO 98/33220 A1 | 7/1998 |

* cited by examiner

*Primary Examiner*—K. Feggins
(74) *Attorney, Agent, or Firm*—Sughrue Mion, PLLC

(57) ABSTRACT

An actuator device including vibration plates formed on one side of a substrate; and piezoelectric elements mounted through the vibration plates and each including a lower electrode, a piezoelectric layer, and an upper electrode, wherein a ratio $d_{31}/S_{11}^E$ of a piezoelectric constant $d_{31}$ of the piezoelectric layer to an elastic compliance $S_{11}^E$ of the piezoelectric layer is greater than 5 C/m$^2$, and the elastic compliance $S_{11}^E$ of each vibration plate is greater than $2\times10^{-8}$ m$^2$/N.

7 Claims, 4 Drawing Sheets

ACTUATOR DEVICE, LIQUID-JET HEAD AND LIQUID-JET APPARATUS

The entire disclosure of Japanese Patent Application No. 2005-233367 filed Aug. 11, 2005 is expressly incorporated by reference herein.

BACKGROUND

1. Technical Field

The present invention relates to an actuator device that includes a piezoelectric element, a liquid-jet head and a liquid-jet apparatus, the liquid-jet head and the liquid-jet apparatus including an actuator device as a driver for spraying liquid droplets.

2. Related Art

An actuator device that includes a piezoelectric element which is displaced according to an applied voltage is mounted on a liquid-jet head that sprays liquid droplets. The liquid-jet apparatus that includes the liquid-jet head may be an ink-jet recording apparatus with an ink-jet recording head having a plurality of pressure generating chambers that generates pressure for ejecting ink droplets by using the piezoelectric element or a heating element, a common reservoir that supplies ink to each pressure generating chamber, and a nozzle orifice communicating with each pressure generating chamber. In the ink-jet recording apparatus, an ejecting energy is applied to the ink in the pressure generating chamber that communicates with a nozzle corresponding to a printing signal, thereby ejecting ink droplets from the nozzle orifice.

As described above, the ink-jet recording head can be classified into two types. In one of the two types of the ink-jet recording head, the heating element such as a resistance line in which Joule heat is generated according to a drive signal is located in the pressure generating chamber, and ink droplets are ejected from the nozzle orifice by using bubbles that are generated by the heating element. In the other (referred to as a piezoelectric vibration type) of the two types of the ink-jet recording head, a part of the pressure generating chamber is configured by using a vibration plate, and ink droplets are ejected from the nozzle orifice by deforming the vibration plate by using the piezoelectric element.

A piezoelectric vibration type ink-jet recording head that employs a piezoelectric actuator which has an axial vibration mode in which the piezoelectric element elongates and shrinks in an axial direction and a piezoelectric vibration type ink-jet recording head that employs a piezoelectric actuator which has a flexural vibration mode have been put to practical use.

In the former piezoelectric vibration type ink-jet recording head, a volume of the pressure generating chamber is changed by contacting an edge face of the piezoelectric element with the vibration plate, thereby producing a head suitable for high density printing. However, a difficult process in which the piezoelectric element is carved for a pectinate shape so that the piezoelectric element is matched to an arrangement pitch of the nozzle orifice or a process in which the carved piezoelectric element is positioned and fixed to the pressure generating chamber is needed, thereby complicating manufacturing processes.

In the latter piezoelectric vibration type ink-jet recording head, the piezoelectric element can be built in the vibration plate by a relatively simple process such as attaching a green sheet made of a piezoelectric material in accordance with a shape of the pressure generating chamber and calcining them. However, since the flexural vibration is used, some area is needed. Accordingly, a high density arrangement is difficult.

In order to solve a problem of the latter recording head, it is disclosed that a uniform piezoelectric material layer is formed on the entire surface of the vibration plate by using a film formation technique, and each piezoelectric element is independently formed in each pressure generating chamber by carving the piezoelectric material layer in accordance with the shape corresponding to the pressure generating chamber by lithography (refer to JP-A-5-286131).

Accordingly, a process of attaching the piezoelectric element to the vibration plate is not needed, and the piezoelectric element is densely built in by lithography which is a precise and simple method. Furthermore, the thickness of the piezoelectric element is reduced, thereby enabling high speed drive.

Strain of the piezoelectric element is maximized in an engineered domain structure in which an angle of θ between the polarization axis (dipole) and an electric field direction is the same at any other domain of the piezoelectric element. In a rhombohedral system, when electric field E is applied in crystalline orientation (001), the maximum strain of the piezoelectric element can be obtained. Composition of piezoelectric crystal is improved so that a piezoelectric constant $d_{31}$ or $d_{33}$ that denotes easiness of strain of piezoelectric substance can be large. Lead magnesium niobate-lead titanate (PMN-PT) (refer to JP-T-2001-509312) or lead zinc niobate-lead titanate (PZN-PT) is known as relaxor ferroelectric single-crystal.

However, although the piezoelectric constant $d_{33}$ of the aforementioned ferroelectric substance is no less than 2500 pC/N, when a load is applied to the ferroelectric substance, the maximum generated stress is about 20 MPa. On the contrary, it has been found that the stress of lead zirconate titanate (PZT) is 35 Mpa, which is greater than that of the aforementioned ferroelectric substance.

SUMMARY

An advantage of some aspect of the invention is to provide an actuator device, a liquid-jet head, and a liquid-jet apparatus that can obtain a large strain of piezoelectric substance by using a low driving voltage.

According to a first aspect of the invention, there is provided an actuator including vibration plates formed on one side of a substrate; and piezoelectric elements mounted through the vibration plates and each including a lower electrode, a piezoelectric layer, and an upper electrode, wherein a ratio $d_{31}/S_{11}^E$ of a piezoelectric constant $d_{31}$ of the piezoelectric layer to an elastic compliance $S_{11}^E$ of the piezoelectric layer is greater than 5 C/m$^2$, and the elastic compliance $S_{11}^E$ of each vibration plate may be greater than $2\times10^{-8}$ m$^2$/N.

In the first aspect of the invention, since the ratio $d_{31}/S_{11}^E$ of the piezoelectric constant $d_{31}$ of the piezoelectric layer to the elastic compliance $S_{11}^E$ of the piezoelectric layer is greater than a predetermined value, and the elastic compliance of each vibration plate is greater than a predetermined value, sufficient strain of the actuator device can be obtained.

According to a second aspect of the invention, in the first aspect of the invention, the ratio $d_{31}/S_{11}^E$ is greater than 7.5 C/m$^2$.

In the second aspect of the invention, since the ratio $d_{31}/S_{11}^E$ of the piezoelectric constant $d_{31}$ of the piezoelectric layer to the elastic compliance $S_{11}^E$ of the piezoelectric layer is greater than 7.5 C/m$^2$, sufficient strain of the actuator device can be obtained, even in a high density actuator.

According to a third aspect of the invention, in the first or second aspect of the invention, the piezoelectric layer is mainly made of lead zirconate titanate ($Pb(Zr, Ti)O_3$), and at least one element selected from a group consisting of yttrium (Y), cesium (Ce), and neodymium (Nd) is infused as an additive.

In the third aspect of the invention, the ratio of the piezoelectric constant $d_{31}$ of the piezoelectric layer to the elastic compliance $S_{11}^E$ of the piezoelectric layer further increases by infusing a predetermined element as the additive into the PZT.

According to a fourth aspect of the invention, in the third aspect of the invention, at least one element selected from a group consisting of niobium (Nb), tantalum (Ta), antimony (Sb), and tungsten (W) is infused as the additive.

In the fourth aspect of the invention, desired characteristics can be further improved by infusing a predetermined element as the additive into the PZT.

According to a fifth aspect of the invention, in the third or fourth aspect of the invention, a mole ratio of the total additives is less than 10 at %.

In the fifth aspect of the invention, the ratio $d_{31}/S_{11}^E$ of the piezoelectric constant $d_{31}$ of the piezoelectric layer to the elastic compliance $S_{11}^E$ of the piezoelectric layer can be easily increased by decreasing an amount of the additives less than a predetermined value.

According to a sixth aspect of the invention, there is provided a liquid-jet head including the actuator device according to any one of the first to fifth aspects of the invention as a pressure generator that generates pressure for ejecting liquid in a pressure generating chamber through a nozzle orifice, in the pressure generating chamber formed on the substrate.

In the sixth aspect of the invention, since the ratio $d_{31}/S_{11}^E$ of the piezoelectric constant $d_{31}$ of the piezoelectric layer to the elastic compliance $S_{11}^E$ of the piezoelectric layer is greater than a predetermined value, and the elastic compliance of each vibration plate is greater than a predetermined value, the liquid-jet head in which sufficient strain of the actuator device can be obtained and large strain can be obtained by using a small voltage can be provided.

According to a seventh aspect of the invention, there is provided a liquid-jet apparatus including the liquid-jet head according to the sixth aspect of the invention.

In the seventh aspect of the invention, the liquid-jet apparatus including the liquid-jet head in which ejection characteristics are remarkably improved can be provided.

DESCRIPTION OF EXEMPLARY EMBODIMENTS

Hereinafter, the invention will be described in detail on the basis of embodiments.

First Embodiment

Figure 1:
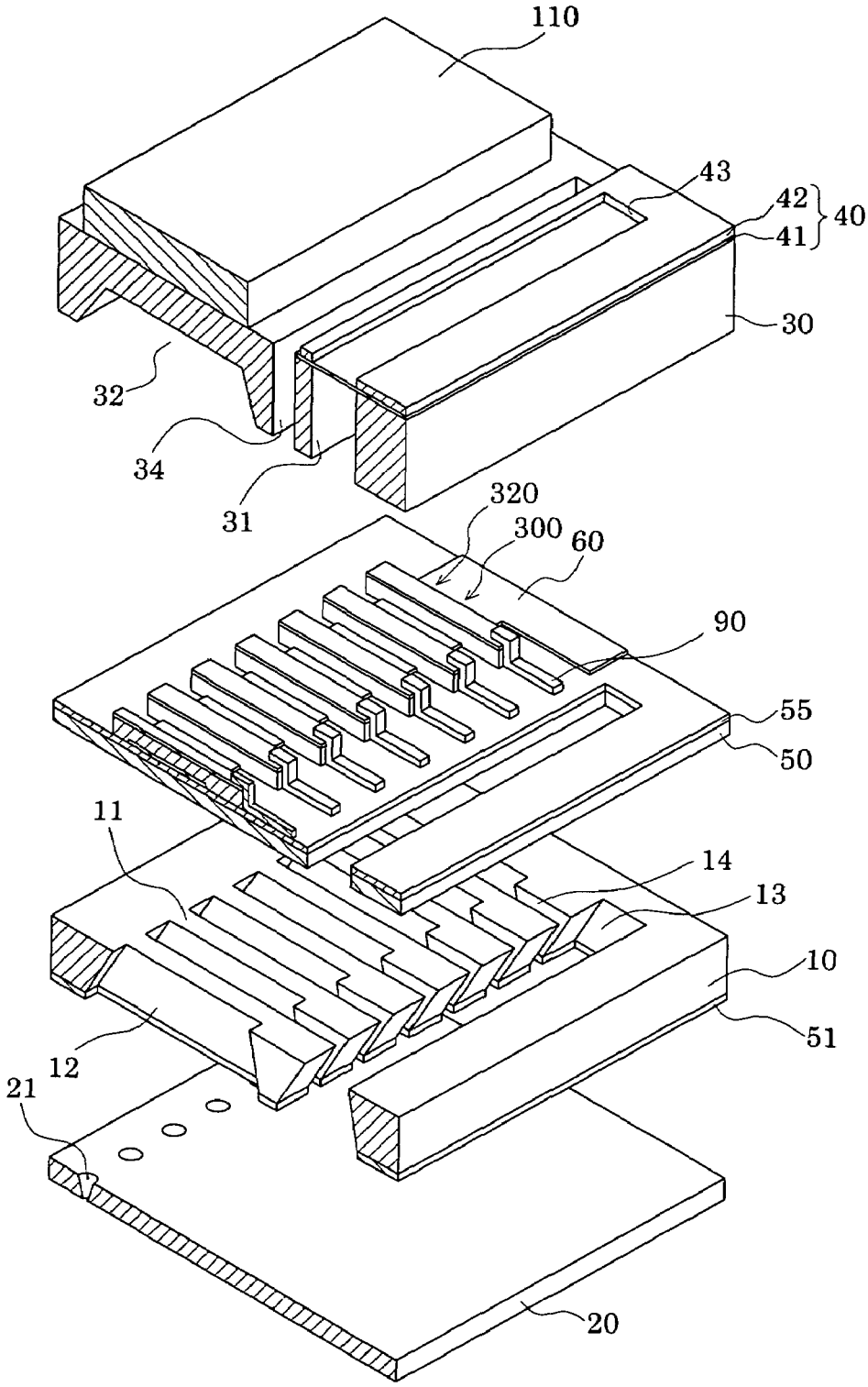
FIG. 1 is an exploded perspective view of a liquid-jet head according to a first embodiment of the invention.
Figure 2A:
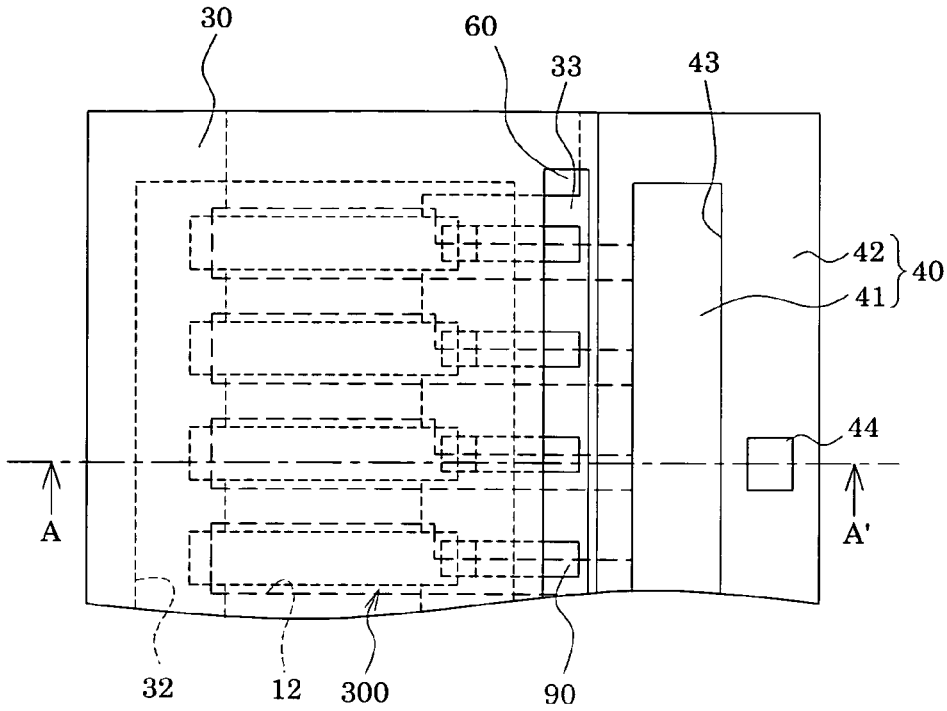
FIGS. 2A and 2B are a top plan view and a cross sectional view of the liquid-jet head according to the first embodiment of the invention.
Figure 2B:
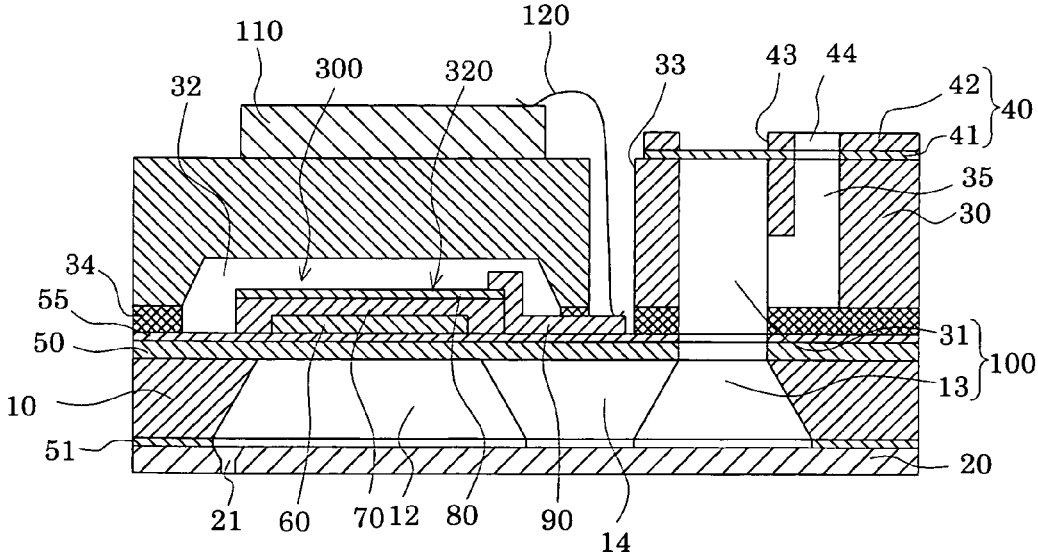

FIG. 1 is an exploded perspective view illustrating a schematic structure of a liquid-jet head according to a first embodiment of the invention. FIGS. 2A and 2B are a top plan view of FIG. 1 and a cross sectional view taken along the line of A-A' of FIG. 1.

As shown in FIG. 1 and FIGS. 2A and 2B, a passage-forming substrate 10 is made of a silicon single-crystal substrate in the present embodiment, and an elastic film 50 with a thickness of 0.5 to 2 μm which is made of silicon dioxide by thermal oxidation is formed on both sides of the silicon single-crystal substrate.

In the passage-forming substrate 10, by anisotropic etching, pressure generating chambers 12 that are partitioned by a plurality of compartment walls 11 are formed in parallel with one another, and a communicating portion 13 that is a part of a reservoir 100 which is a common ink chamber of the pressure generating chambers 12 is formed outside the pressure generating chambers 12 in a longitudinal direction thereof to communicate with one end of each pressure generating chamber 12 in a longitudinal direction thereof through ink supply paths 14. The ink supply paths 14 have a narrower width than the pressure generating chambers 12 to maintain passage resistance of ink that is introduced into the pressure generating chambers 12 from the communicating portion 13 to be constant.

On an opening portion side of the passage-forming substrate 10, a nozzle plate 20 through which nozzle orifices 21 that communicate with the pressure chambers 12 at the opposite side of the ink supply paths 14 are formed is fixed through an adhesive layer 51 such as an adhesive agent or heat sealing film. The nozzle plate 20 has a thickness, for example, 0.01 to 1 mm. The nozzle plate 20 is made of, for example, glass-ceramics or stainless steel with a linear expansion coefficient of 2.5 to 4.5[$\times 10^{-6}$/° C.] below a temperature 300° C. The nozzle plate 20 covers the entire surface of one side of the passage-forming substrate 10 and serves as a reinforcing plate that protects the silicon single crystal substrate from impact or external force. The nozzle plate 20 may be made of a material that has substantially the same thermal expansion coefficient as the passage-forming substrate 10. In the aforementioned case, since strain of the passage-forming substrate 10 due to heat is substantially the same as that of the nozzle plate 20, they are easily joined by using a photo-setting adhesive agent.

On the opposite side of the opening portion side of the passage-forming substrate 10, as described above, the elastic film 50 with a thickness of about 1.0 μm which is made of silicon dioxide is formed, and an insulation film 55 with a thickness of about 0.4 μm which is made of zirconium dioxide ($ZrO_2$) is laminated on the elastic film 50. On the insulation film 55, a lower electrode film 60 with a thickness of about 0.1 to 0.5 μm which is made of iridium (Ir), a piezoelectric layer 70 with a thickness of, for example, about 0.1 μm which is made of lead zirconate titanate (PZT), and an upper electrode film 80 with a thickness of, for example, about 0.05 μm which is made of gold, platinum, or iridium are laminated in a process to be described later, to forma piezoelectric element 300. Here, the piezoelectric element 300 is a portion that includes the lower electrode film 60, the piezoelectric layer 70, and the upper electrode film 80. In general, one electrode of the piezoelectric element 300 serves as a common electrode, and the other electrode and the piezoelectric layer 70 are patterned for each pressure generating chamber 12. A portion that includes the patterned electrode and piezoelectric layer 70 and is strained by applying a voltage to the both electrodes is referred to as a piezoelectric active portion 320. In the present embodiment, the lower electrode film 60 is used as the common electrode of the piezoelectric element 300, and the upper electrode film 80 is used as individual electrodes. However, this arrangement may be in reversed for convenience of arrangement of driving circuits and wiring. In any case, the piezoelectric active portion 320 is formed at each pressure generating chamber 12. The piezoelectric element 300 and a vibration plate that is displaced by driving the piezoelectric element 300 are referred to as an actuator device. The elastic film 50 and the insulation film 55 may be patterned to function as the vibration plate, or the lower electrode film 60 that constitutes the piezoelectric element 300 may function as the vibrating plate.

The piezoelectric layer 70 may be made of a material of which a ratio $d_{31}/S_{11}^E$ of a piezoelectric constant $d_{31}$ to an elastic compliance $S_{11}^E$ is greater than 5 C/m$^2$ and preferably greater than 7.5 C/m$^2$. It is preferable that the elastic compliance $S_{11}^E$ of the vibration plate is greater than $2\times10^{-8}$ m$^2$/N.

The piezoelectric layer 70 is made of the material of which the ratio $d_{31}/S_{11}^E$ of the piezoelectric constant $d_{31}$ to the elastic compliance $S_{11}^E$ is no less than a predetermined value, so that strain in a thin film type actuator device may be sufficiently large to obtain a sufficient amount of liquid ejected from the liquid-jet head when the thin film type actuator device is used as the liquid-jet head.

More specifically, sufficient strain in the thin film type actuator cannot be obtained only by improving the piezoelectric constant as in the past, and therefore, the ratio of the piezoelectric constant of the piezoelectric layer to the elastic compliance of the piezoelectric layer is important. That is, although it is needless to say that the piezoelectric constant of the piezoelectric layer 70 for driving the vibration plate is large to some degree, the invention has been achieved on the basis of a finding that the sufficient strain of the piezoelectric layer 70 cannot be obtained without some degree of hardness.

In order to improve the piezoelectric characteristic of the thin film, it is necessary to increase $d_{31}$ while the elastic compliance does not increase more than needs. For example, when an additive is added in high concentration, as in a bulk material, the compliance increases, thereby not working on a load. While strain is a driving source in the thin film, strain sensitivity with respect to a voltage at a low voltage area is a driving source in the bulk material. Accordingly, the amount of the additive in the thin film, which is to be described later, is completely different from that in the bulk material.

A stress generated when driving the aforementioned piezoelectric element 300 is calculated by an equation as follows.

$$\text{Generated stress}=(d_{31}/S_{11}^E)\cdot(V/t_{pzt})$$

where V is a voltage applied to the piezoelectric layer 70, and $t_{pzt}$ is a thickness of the piezoelectric layer 70.

When Young's modulus of the piezoelectric layer 70 is $E_{pzt}$, since $E_{pzt}=(1/S_{11}^E)$, the generated stress is calculated by the following equation.

$$\text{Generated stress}=E_{pzt}\cdot d_{31}\cdot(V/t_{pzt})$$

When the generated stress is no more than elastic force of the strained vibration plate, the liquid cannot be ejected. The elastic force of the vibration plate, that is, the stress of the vibration plate is calculated by an equation as follows.

Stress of the vibration plate$=[E_{Sub}\cdot(t_{sub})^2/W^2t_{pzt}]\cdot\delta$ where $E_{Sub}$ is Young's modulus of the vibration plate, $t_{Sub}$ is a thickness of the vibration plate, W is a width of the vibration plate, and δ is a displacement of the vibration plate.

Here, the condition that the ratio $d_{31}/S_{11}^E$ of the piezoelectric constant $d_{31}$ of the piezoelectric layer 70 to the elastic compliance $S_{11}^E$ of the piezoelectric layer 70 is greater than 5 C/m$^2$ is a condition on which a flexural displacement of about 300 nm can be obtained and a practical amount of the liquid ejected from a 360 dpi liquid-jet head can be obtained. When the ratio $d_{31}/S_{11}^E$ is greater than 7.5 C/m$^2$, the flexural displacement of the vibration plate is about 500 nm.

On the other hand, in order to eject the liquid by using the actuator device in, for example, the liquid-jet head, the elastic compliance $S_{11}^E$ of the vibration plate is preferably greater than $2\times10^{-8}$ m$^2$/N.

The piezoelectric layer 70 that is made of a material of which the ratio $d_{31}/S_{11}^E$ of the piezoelectric constant $d_{31}$ to the elastic compliance $S_{11}^E$ is greater than 5 C/m$^2$ and preferably greater than 7.5 C/m$^2$ is preferably made of lead zirconate titanate (PZT). This is because the piezoelectric layer 70 of which the hardness and the piezoelectric constant are sufficiently large can be embodied by using PZT. Lead magnesium niobate-lead titanate (PMN-PT) or lead zinc niobate-lead titanate (PZN-PT) that has been developed as a material of which the piezoelectric constant is remarkably large is too soft to satisfy the aforementioned conditions.

An additive that does not remarkably decrease the hardness of the PZT and improves the piezoelectric constant of the PZT may be infused into the PZT. The aforementioned additive may be an element selected from the group consisting of yttrium (Y), cesium (Ce), and neodymium (Nd). Yttrium (Y) or cesium (Ce) increases a crystallization rate and improves thermal stability of the PZT. Neodymium (Nd) uniformizes composition distribution and thereby improves the piezoelectric constant of the PZT.

In addition to the aforementioned element, an element selected from the group consisting of niobium (Nb), tantalum (Ta), antimony (Sb), and tungsten (W) may be further infused into the PZT. Niobium (Nb) prevents oxygen deficiency, tantalum (Ta) increases the compliance to easily distort the PZT, antimony (Sb) decreases the compliance, and tungsten (W) increases permittivity to improve linearity of displacement with respect to voltage. Even when any one of the aforementioned elements is used together with the aforementioned yttrium (Y), cesium (Ce), and neodymium (Nd), any one of the aforementioned elements is effective.

A mole ratio of the total additives may be less than 10 at %. When the additives no less than 10% is added, the piezoelectric layer 70 is softened, that is, Young's modulus decreases, thereby not satisfying the aforementioned conditions. The aforementioned additives exist as oxidized additives in the PZT.

The piezoelectric layer 70 is laminated in a predetermined thickness, for example, about 0.5 to 2 μm by using the aforementioned material, so that the piezoelectric constant or Young's modulus may be a predetermined value in the invention.

A crystalline orientation of the piezoelectric layer 70 is preferably (100). In order to form the piezoelectric layer 70, the piezoelectric layer may be freely grown by forming the titanium layer on the lower electrode layer 60, may be epitaxially grown by forming the lower electrode film 60 in the crystalline orientation (100), or may be located through a foundation layer on the lower electrode film 60. The structure of the piezoelectric layer 70 is not limited to the aforementioned cases.

Each lead electrode 90 that is made of, for example, gold (Au), extracted from the vicinity of the end portion on the ink supply path 14 side, and extends onto the insulation film 55 is connected each upper electrode film 80 that is an individual electrode of the piezoelectric element 300.

A protective plate 30 that includes a reservoir portion 31 constituting at least a part of the reservoir 100 is attached on the passage-forming substrate 10 over which the aforementioned piezoelectric element 300 is formed, that is, on the lower electrode film 60, the insulation film 55, and the lead electrode 90, by using an adhesive agent 34. According to the present embodiment, the reservoir portion 31 passes through the protective plate 30 in the thickness direction of the protective plate 30 to communicate with the communicating portion 13 of the passage-forming substrate 10 and is formed in the width direction of the pressure chambers 12, thereby constituting the reservoir 100 that is the common ink chamber of the pressure chambers 12.

A piezoelectric element holding portion 32 that has enough space to vibrate the piezoelectric element 300 is formed in the area of the protective plate 30 that faces the piezoelectric element 300. The protective plate 30 may have space enough to vibrate the piezoelectric element 300. The space may or may not be sealed.

The protective plate 30 is preferably made of a material, for example, glass, ceramic material, and the like which has substantially the same thermal expansion coefficient as the passage-forming substrate 10. In the present embodiment, the protective plate 30 is formed by using a silicon single crystal substrate that is made of the same material as the passage-forming substrate 10.

The protective plate 30 includes a penetrated hole 33 that penetrates the protective plate 30 in the thickness direction thereof. The vicinity of the end portion of the lead electrode 90 that is extracted from the each piezoelectric element 300 is provided so as to be exposed within the penetrated hole 33.

A driving circuit 110 for driving the juxtaposed piezoelectric elements 300 is fixed on the protective plate 30. The driving circuit 110 may be, for example, a circuit substrate or semiconductor integrated circuit (IC). The driving circuit 110 and the lead electrodes 90 are electrically connected through connection wires 120 that are conductive wires such as bonding wires.

A compliance substrate 40 that includes a sealing film 41 and a fixing plate 42 is attached onto the protective substrate 30. The sealing film 41 is made of a material that has flexibility and low rigidity (for example, a polyphenylene sulfide (PPS) film with a thickness of 6 μm). One side of the reservoir portion 31 is sealed by the sealing film 41. The fixing plate 42 is made of a hard material such as metal (for example, stainless steel (SUS) with a thickness of 30 μm, etc). An area of the fixing plate 42 which faces the reservoir 100 serves as an opening portion where the fixing plate 42 is completely removed in the thickness direction thereof, and therefore, one side of the reservoir 100 is sealed only by the sealing film 41 having flexibility.

An ink introducing port 44 for supplying ink to the reservoir 100 is formed on the compliance substrate 40 at outer side of the reservoir 100 in the substantially middle in the length direction of the reservoir 100. An ink introducing passage 35 through which the ink introducing port 44 communicates with a side wall of the reservoir 100 is formed in the protective plate 30.

In the ink-jet recording head according to the present embodiment, ink is introduced from the ink introducing port 44 connected to an external ink supply means (not shown). A voltage is applied, according to a recording signal from the driving circuit, between each lower electrode film 60 and each upper electrode film 80 corresponding to the pressure generating chamber 12 after the ink is filled inside from the reservoir 100 up to the nozzle orifices 21, and the elastic film 50, the insulation film 55, the lower electrode film 60, and the piezoelectric layer 70 are flexurally strained, thereby increasing the pressure in each pressure generating chamber 12 to eject ink droplets from the nozzle orifices 21.

EMBODIMENT

On the condition that the ratio $d_{31}/S_{11}^{E}$ of the piezoelectric constant d31 of the piezoelectric layer 70 to the elastic compliance $S_{11}^{E}$ of the piezoelectric layer 70 is greater than 5 $C/m^2$, when electric field strength $E=(V/t_{pzt})$ is 25 V/μm, the generated stress $E_{pzt}\cdot d_{31}\cdot E$ has to be greater than 12.5 MPa. On the other hand, when the displacement δ is no less than 360 nm, the corresponding strain needs to be no less than 0.35%. The relation between the strain and the generated stress with respect to three types of piezoelectric layers such as PZT, Y-doped PZT (Y: 13 at % addition), and PZN-PT is shown in FIG. 3.

Figure 3:
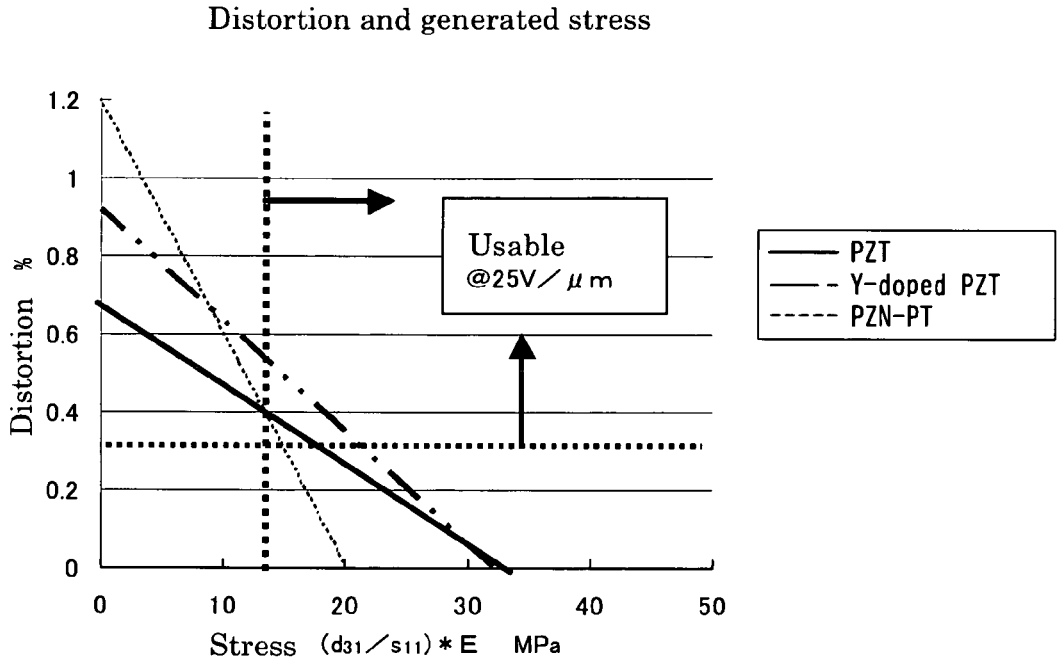
FIG. 3 is a graph illustrating relation between strain and generated stress according to an embodiment of the invention.

Referring to FIG. 3, in the case of PZT or Y-PZT, a usable range of satisfying the condition of the invention is wide, however, in the case of PZN-PT, a piezoelectric layer that satisfies the condition of the invention can not be obtained.

First Embodiment

When the composition of the piezoelectric layer is $(Pb_{1.05}Y_{0.03})(Zr_{0.53}Ti_{0.44}X_{0.03})$, and X is niobium (Nb), tantalum (Ta), antimony (Sb), and tungsten (W), $d_{31}/S_{11}^{E}(C/m^2)$ is obtained, respectively. The result is shown in Table 1.

Second Embodiment

When the composition of the piezoelectric layer is $(Pb_{1.05}Ce_{0.03})(Zr_{0.53}Ti_{0.44}X_{0.03})$, and X is niobium (Nb), tantalum (Ta), antimony (Sb), and tungsten (W), $d_{31}/S_{11}^{E}(C/m^2)$ is obtained, respectively. The result is shown in Table 1.

Third Embodiment

When the composition of the piezoelectric layer is $(Pb_{1.05}Ce_{0.03}Y_{0.02})(Zr_{0.53}Ti_{0.44}X_{0.03})$, and X is (Nb+Ta), (Nb+Sb) (Nb+W), (Ta+Sb), and (Ta+W), $d_{31}/S_{11}^{E}(C/m^2)$ is obtained, respectively. The result is shown in Table 1.

TABLE 1

| | A site | B site | $d_{31}/S_{11}^{E}$ $(C/m^2)$ |
|---|---|---|---|
| First Embodiment | Y | Nb | 7 |
| | Y | Ta | 8 |
| | Y | Sb | 6 |
| | Y | W | 8 |
| Second Embodiment | Ce | Nb | 7.2 |
| | Ce | Ta | 8.1 |
| | Ce | Sb | 6.5 |
| | Ce | W | 9 |
| Third Embodiment | Y + Ce | Nb + Ta | 7 |
| | Y + Ce | Nb + Sb | 8 |
| | Y + Ce | Nb + W | 6.7 |
| | Y + Ce | Ta + Sb | 9 |
| | Y + Ce | Ta + W | 6.5 |

As a result, it is found that in the case of the PZT into which the additive is infused, the piezoelectric layer that can be applied to the invention can be widely manufactured.

An Other Embodiment

Although the embodiments of the invention have been described, constructions of the invention are not limited to the aforementioned descriptions.

Figure 4:
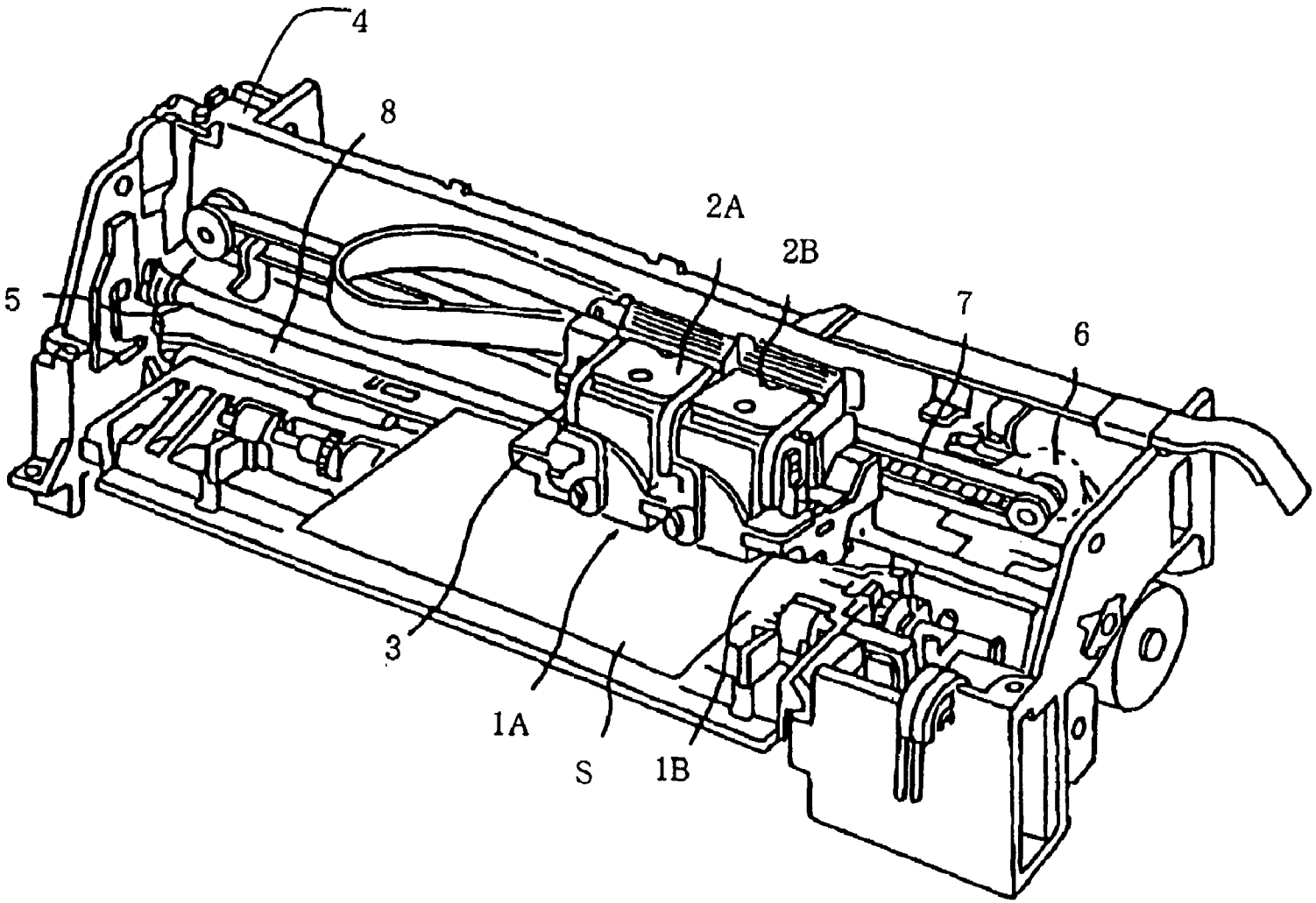
FIG. 4 is a schematic perspective view of an ink-jet recording apparatus according to another embodiment of the invention.

The liquid-jet head according to the invention which is a part of a recording head unit including an ink passage connected to an ink cartridge or the like is mounted on the liquid-jet apparatus. FIG. 4 is a schematic perspective view of an ink-jet recording apparatus according to another embodiment of the invention.

As shown in FIG. 4, cartridges 2A and 2B that constitute an ink supply means are detachably mounted in recording head units 1A and 1B that have the liquid-jet head, and a carriage 3 on which the recording head units 1A and 1B are mounted is provided so that the carriage 3 can be moved in the axial direction of a carriage axis 5 that is attached to a apparatus body 4. The recording head units 1A and 1B eject, for example, black ink composition and color ink composition, respectively.

A driving force of a driving motor 6 is transmitted to the carriage 3 through a plurality of gears (not shown) and a timing belt 7, so that the carriage 3 on which the recording head units 1A and 1B are mounted is moved along the carriage axis 5. In the apparatus body 4, a platen 8 is arranged along the carriage axis 5. A recording sheet S that is a recording medium such as a sheet of paper fed by a paper feed roller (not shown) or the like is delivered onto the platen 8.

Although, the liquid-jet head has been described in the aforementioned embodiments as an example of the liquid-jet head according to the invention, the basic construction of the liquid-jet head is not limited to the aforementioned descriptions. The invention widely targets general liquid-jet heads, for example, various recording heads used for an image recording apparatus such as a printer, a color material jet head used for producing a color filter of a liquid crystal display device and the like, an electrode material jet head used for forming electrodes of an organic electro luminescence (EL) display, a field emission display (FED) (surface emitting display), and the like, and a bioorganic material jet head used in producing a biochip.

The invention is not limited to the liquid-jet apparatus in which the liquid-jet head is mounted.

The invention can be applied to an actuator device that is mounted on all the apparatus in addition to the actuator device that is mounted as a pressure generating means on the liquid-jet head. For example, the actuator device can be applied to a sensor and the like in addition to the aforementioned head.

What is claimed is:

1. An actuator device comprising:

vibration plates formed on one side of a substrate; and piezoelectric elements mounted through the vibration plates and each including a lower electrode, a piezoelectric layer, and an upper electrode, wherein a ratio $d_{31}/S_{11}^{E}$ of a piezoelectric constant $d_{31}$ of the piezoelectric layer to an elastic compliance $S_{11}^{E}$ of the piezoelectric layer is greater than 5 $C/m^2$, and the elastic compliance $S_{11}^{E}$ of each vibration plate is greater than $2\times10^{-8}$ $m^2/N$.

2. The actuator device according to claim 1, wherein the ratio $d_{31}/S_{11}^{E}$ is greater than 7.5 $C/m^2$.

3. The actuator device according to claim 1, wherein the piezoelectric layer is mainly made of lead zirconate titanate ($Pb(Zr, Ti)O_3$), and at least one element selected from a group consisting of yttrium (Y), cesium (Ce) and neodymium (Nd) is infused as an additive.

4. The actuator device according to claim 3, wherein at least one element selected from a group consisting of niobium (Nb), tantalum (Ta), antimony (Sb), and tungsten (W) is infused as the additive.

5. The actuator device according to claim 3, wherein a mole ratio of the total additives is less than 10 at %.

6. A liquid-jet head comprising the actuator device according to claim 1 as a pressure generator that generates pressure for ejecting liquid in a pressure generating chamber through a nozzle orifice, in the pressure generating chamber formed on the substrate.

7. A liquid-jet apparatus comprising the liquid-jet head of claim 6.

* * * * *